United States Patent [19]

Kawatsu

[11] Patent Number: 4,848,683

[45] Date of Patent: Jul. 18, 1989

[54] CRUSHING MEMBERS USED IN PULVERIZERS

[75] Inventor: Hajime Kawatsu, Osaka, Japan

[73] Assignee: Ing. Shoji Co., Ltd., Osaka, Japan

[21] Appl. No.: 128,423

[22] Filed: Dec. 3, 1987

[30] Foreign Application Priority Data

Dec. 9, 1986 [JP] Japan ..... 61-292884

[51] Int. Cl.[4] ..... B02C 4/30

[52] U.S. Cl. ..... 241/294; 241/300

[58] Field of Search ..... 29/121.2, 110, 132, 29/130; 241/117, 207, 300, 293, 294, 295, 228, 221, 235, 291

[56] References Cited

U.S. PATENT DOCUMENTS

| | | | |
|---|---|---|---|
| 278,272 | 5/1883 | Rickerson | 241/235 |
| 883,619 | 3/1908 | Canda | 241/300 X |
| 887,003 | 5/1908 | Michaelsen | 241/300 X |
| 3,804,346 | 4/1974 | Norman | 241/300 X |
| 4,380,852 | 4/1983 | Leschinsky et al. | 29/121.2 |

FOREIGN PATENT DOCUMENTS

| | | | |
|---|---|---|---|
| 321009 | 5/1920 | Fed. Rep. of Germany | 241/300 |

*Primary Examiner*—Mark Rosenbaum

*Attorney, Agent, or Firm*—Oblon, Spivak, McClelland, Maier & Neustadt

[57] ABSTRACT

The crushing surfaces (a) or (b) are composed of two types of blocks 1 and 2 which differ in wear resistance and which are arranged alternately.

10 Claims, 6 Drawing Sheets

CRUSHING MEMBERS USED IN PULVERIZERS

FIELD OF THE INVENTION

The present invention relates to crushing members used in pulverizers of the type in which the material to be pulverized is nipped between crushing surfaces. Pulverizers of this type include, e.g., roll pulverizers, cone crushers, ring roll mills, vertical roller mills, edge runners, etc.

BACKGROUND OF THE INVENTION

Heretofore, various materials such as iron ore, coal, coke, graphite, converter slag, blast furnace slag, limestone, clinker, rock, etc. have been crushed by roll crushers, cone crushers, ring roll mills, vertical roll mills, etc. The pulverization principle involved in the functioning of these pulverizers is described in the following with reference to FIG. 9.

Roll Crusher

As shown in FIG. 9(*a*), a pair of rolls A and B having cylindrical surfaces a and b make turns to effect pulverization of the material to be pulverized by compression and shearing exerted between the rolls A and B.

Cone Crusher

As shown in FIG. 9(*b*), the material to be pulverized is crushed by compression and shearing in a crushing space formed between a male member, or mantle, A having a truncated cone outer surface which gyrates while rotating about its own axis and a fixed cone female member B having an inverse truncated cone inner surface b.

Ring Roll Mill

As shown in FIG. 9(*c*), a plurality of rolls A each having a cylindrical surface a are gyrated at a high speed while thrusting the rolls onto the fixed ring B having an inner cylindrical surface b, thereby effecting crushing of the material to be pulverized therebetween.

Vertical Roller Mill

As shown in FIG. 9(*d*), while turning a crushing table A having a plane surface a, two crushing rollers B each having a cylindrical surface b are pressured onto the pulverizing table A, so that material to be pulverized which has fallen near the center of the pulverizing table A is pulverized by the compression, impact, and shearing action of the table A and the rollers B, while being transferred outward by centrifugal force. Of course, in vertical roller mills, the pulverizing rollers B and the pulverizing table A are not restricted to having cylindrical surfaces b and plane surfaces a, but may include a combination of a table liner with a ring groove and a ring roller disposed therein.

One of the conditions required for increasing the output per unit time in all of these crushers is to produce a situation for facilitating the nipping of the material between the crushing surfaces of the members A and B (for example, between a roller and a table liner, between a roll and a ring, between a mantle and a cone, etc.).

Taking a ring roll mill as an example, when new product rolls A begin to be used, the pulverizing efficiency is low, depending on the type of material. This is because the crushing surface a (in this case, the cylindrical surface) of the roll A is smooth, resulting in inadequate nipping-in. Then, as wavy wear begins occurring on the rolls A after operating them for a while, a pulverizing efficiency rise has often been experienced. On this ground, as a means for enhancing the pulverizing efficiency, a method which comprises initially providing the crushing surface a of the roll A with striped protrusions 4 such as are shown in FIG. 10 has heretofore been adopted. Such a means, its use not limited to rolls of ring roll mills, is employed in the form of providing rolls of roll pulverizers with a wavy or serrate shape. Also, the mantle surfaces of some cone crushers are serrated, and several lines of striped protrusions are provided on the rollers or table liners of vertical roller mills, etc.

Initially providing the pulverizing surfaces a and b with striped protrusions 4 has the effect of increasing the pulverizing efficiency from the beginning of pulverization, thereby augmenting the output tonnage per hour. This is believed to result from the fact that these protrusions function to improve the nipping-in.

However, high striped protrusions 4, if provided on the crushing surfaces A and B, will cause evolution of vibration and noise. Therefore, the height of the striped protrusions 4 is naturally subject to limitation. Moreover, if the striped protrusions 4 are too high, they will wear away immediately after starting the operation, thus failing to attain a significant effect in increasing the crushing efficiency.

Of late, the pulverizing cost has been notably raised due to the increases in the power cost for crushers, is the cost of consumable members, and, further, in the labor cost expended for their replacement. When high priced materials are pulverized, the high cost thereof may be absorbed by the added values. However, the materials to be pulverized are often low priced, and with such materials presently there is available no means to enable absorption of the high pulverizing cost other than by increasing the output per unit time.

OBJECT OF THE INVENTION

In view of the situation hereabove described, the principal object of the present invention is to provide crushing surface members the crushing efficiency of which rapidly increases after starting the operation and the high crushing efficiency of which is continuously maintained for a long time until their durability period expires.

SUMMARY OF THE INVENTION

The basic composition of the crushing surface members of this invention will be described hereunder with reference to FIG. 1, taking the rolls used in roll crushers, ring roll mills, etc., as examples.

The material is pulverized by being nipped between a roll A, which is one of the crushing surface members, and the other crushing surface member B (not shown in this figure). The direction X in which the material is nipped on the crushing surfaces a is in the roll circumferential direction.

On the roll A of this invention, as shown in this figure, two types of blocks 1 and 2 which are different in wear resistance are alternately arranged in at least the surface layer part in the direction X in which the material is nipped on the crushing surface a, or in the roll circumferential direction.

When pulverization of a material is made with a roller A of this invention, with a block 2 specified to be inferior to another block 1 in wear resistance, as shown in FIGS. 2(*a*) and 2(*b*), wear will occur sooner on the top crushing surface of the block 2 having lower wear resistance than on the block 1 having higher wear resistance, spontaneously forming recesses with depth 1, as shown in FIG. 2(*b*).

As this situation has been brought about, the nipping-in of the material has been improved and the pulverizing efficiency is abruptly elevated. Thereafter, a constant level production efficiency will be continuously maintained until the block 1 having higher wear resistance are worn away to their usable limit.

Thus, once a recess with the specified depth is formed, the top of the block 2 having the lower wear resistance will undergo wear at the same rate as the wear on the block 1 having the higher wear resistance. As a consequence, the recesses will maintain the same depth at all times.

The recesses are spontaneously produced. Moreover, the state of the recesses being formed is, as it were, a state provided with a non-slip contour, which will rarely serve as a factor for producing noise or vibration.

DETAILED DESCRIPTION OF THE PRESENTLY PREFERRED EMBODIMENTS

In the following, working variations of this invention will be described in detail.

Arrangement of the Components

Figure 1:
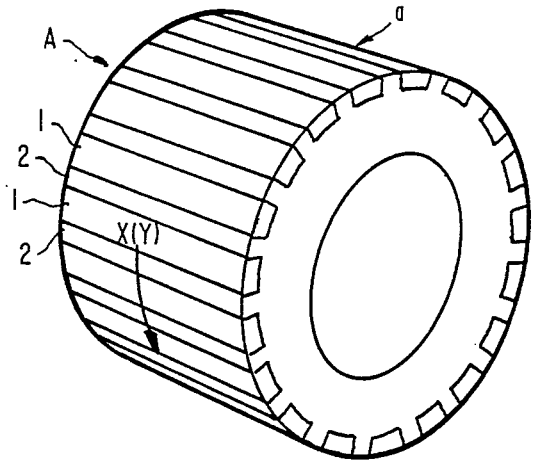
FIG. 1 is a perspective view of a roll illustrating the basic composition of this invention.
Figure 10:
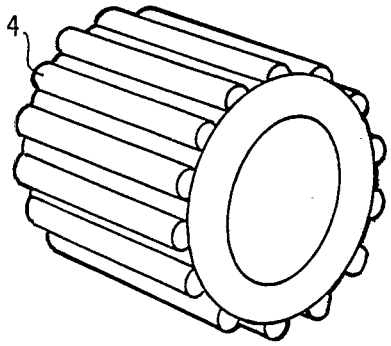
FIG. 10 PRIOR ART
FIG. 10 is a perspective view illustrating a crushing surface member of a roll to which a conventional countermeasure has been applied.
Figure 3:
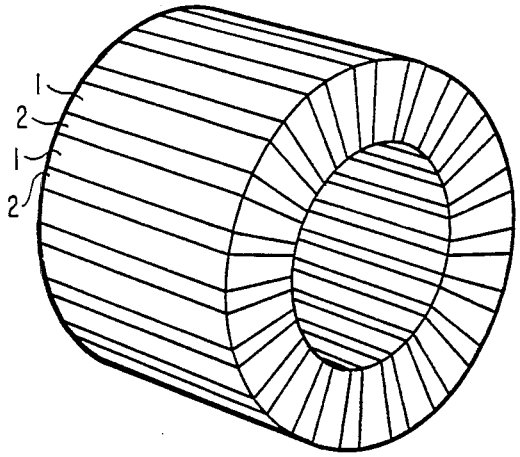
FIGS. 3 and 4 are perspective views of rolls illustrating variations of the structure of this invention.

With regard to the arrangement of the wear resistant blocks 1 and the spacer blocks 2, as shown in FIG. 1, basically they should exist in the surface layer of either crushing surface member A or B, but they may reach to the intermediate part of the crushing member. Further, as shown in FIG. 3, they may extend the whole working depth of either crushing surface member. From the standpoint of cost, their existence should preferably be limited to the surface part of a depth such that the amount of the high priced wear resistance block 1 used may be reduced.

When the crushing surface members A and B are rollers, the peripheral direction of the circumferential surface of the roll is the direction X in which the material is nipped on the crushing surfaces a and b. Therefore, the blocks 1 and 2 are also alternately arranged in the peripheral direction of the roll circumference. Also on the mantle A and the cone B in cone crushers, the ring B in ring roll mills, and the rollers B in vertical roller mills, as shown in FIG. 9, the peripheral direction of the crushing surfaces a and b (i.e., the circumferential surfaces) is the direction X in which the material is nipped, and in this direction the blocks 1 and 2 are alternately arranged. On the table A of the vertical roller mill, the circumferential direction of the crushing surface a (the plane surface) is the direction X in which the material is nipped, and the blocks 1 and 2 are arranged alternately in this direction—or, as it were, radially.

Figure 4:
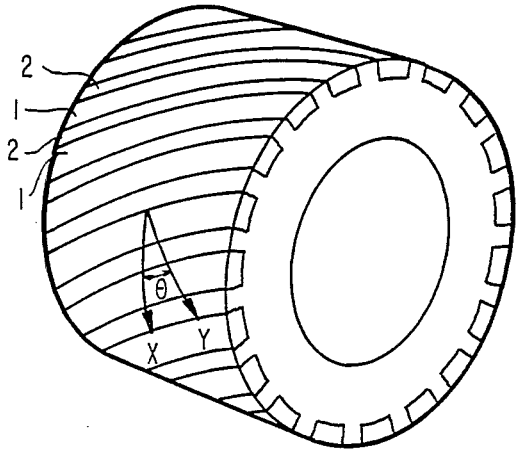

When the blocks 1 and 2 are alternately arranged, as shown in FIG. 1, the direction of their arrangement Y may not necessarily be in complete agreement with the direction X in which the material is nipped on the crushing surfaces a and b, but it may be at an angle of $\theta$ to the direction X in which the material is nipped, as shown in FIG. 4. In this instance, the angle $\theta$ should preferably be smaller than 45 degrees. If it exceeds 45 degrees, the pulverizing efficiency will decline, thus failing to attain the objective as well as causing shearing force to be exerted between the crushing surface members A and B, requiring an increase in the mixing capacity.

Figure 8A:
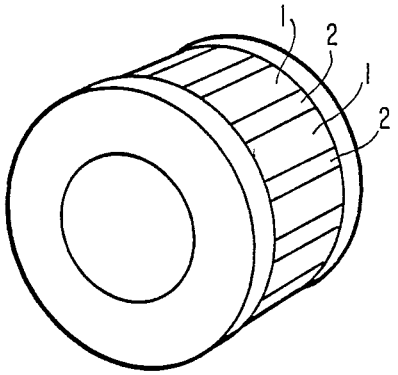
FIG. 8(*a*) and 8(*b*) are explanatory diagrams of a roll used for a test for confirmation of the effect of application of this invention, FIG. 8(*a*) giving a perspective view and FIG. 8(*b*) giving a sectional view.

The structure of the blocks 1 and 2 may be selectively employed in a part where otherwise wear is notable, as shown in FIG. 8*a*, and such a structure is often more reasonable than the structure shown in FIGS. 1–4.

The Wear Resistant Blocks

Each wear resistant block 1 is a block of a material showing adequate wear resistance, as currently used in the surface layer part of the crushing surface members A and B of conventional pulverizers. This includes blocks such as are formed of, e.g., ceramics, high chrome cast iron, sintered hard alloys, various types of tool steels, cermet base alloys, etc.

Figure 5:
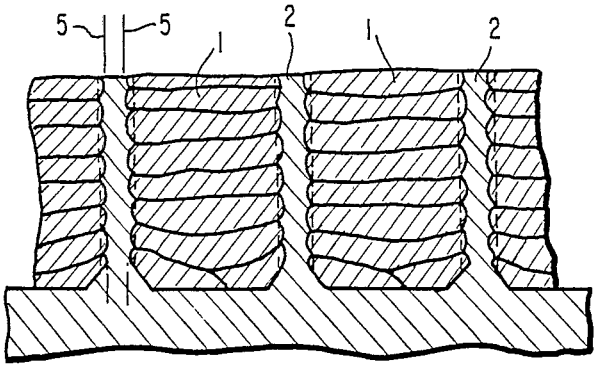
FIGS. 5 and 6 are sectional views of rolls showing variations of the wear resistance blocks and spacer blocks.

Such a block 1 molded beforehand, as shown in FIG. 2, may be fitted and stuck in each groove formed between each two spacer blocks 2, 2 making use of an adhesive, soldering, bolts, other mechanical means, etc., or may be a hardened metal formed by casting wear resistant molten metal in each recess, or, as shown in FIG. 5, a hardened weld metal formed by various types of padding (including plasma powder overlay welding).

In this instance, the hardened padding method is most preferable. The main reasons for this are: that selection of the hardened alloy suitable as the material is easy; that, in plasma powder padding, any intended alloy may be readily formed by altering the mixture of alloy powders; and that, in the padding method, any part of the hardened alloy which has been unevenly worn may be readily compensated for by padding. Thus, this method's workability is quite high, and its maintenance is simple. Accordingly, it is more advantageous than other methods.

In the case of casting or padding, it should be avoided that the hardened metal separated by a spacer block 2 melts and penetrates into the spacer block 2 and is unified with the spacer block 2. If the melting causes such penetration, the basic composition of this invention will become unrealizable. The weld penetration line 5 of the spacer block 2 should desirably be kept straight so far as practical and not be irregularly drawn.

The wear resistance of the wear resistant block 1 substantially governs the life of the pulverizing surface members A and B.

The Spacer Blocks

Figure 6:
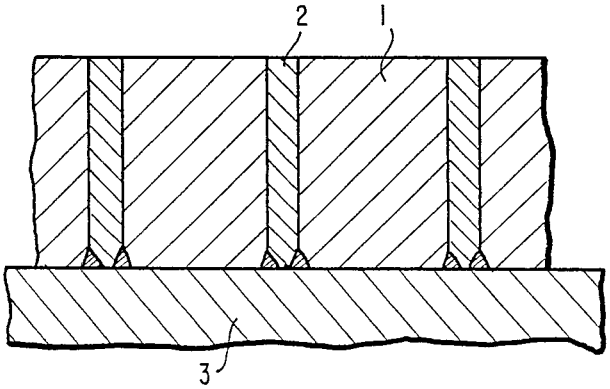

The spacer blocks 2, besides being integrally formed with the substrate part 3 of the crushing surface members A and B with the same material as the substrate part 3, may be formed separately from the substrate part 3 and attached, as shown in FIG. 6, by welding, soldering, adhesives, or other mechanical joining methods, or by various surface hardening overlay welding or plasma powder padding techniques, spray coated padding, etc.

In the case of separate body joining, the material of the spacer block 2 may be altered relative to the material of the substrate part 3 (e.g., to SKD6 tool steel, high speed steel flat bars, etc.) for facility in adjusting the wear resistance difference between it and the wear resistant blocks 1.

As for the difference in wear resistance between the wear resistant blocks 1 and the spacer blocks 2, if it is small, the recess formed between adjacent wear blocks will be very small, resulting in low material nipping-in efficiency. Conversely, if it is large, deep recesses will be formed, thus enhancing the material nipping-in efficiency, but adversely giving cause to evolution of noise or vibration. On this ground, with regard to the wear resistance of the spacer blocks 2, 10–90% reduction in wear resistance from the wear resistant blocks 1 is permissible, as evaluated in terms of the reciprocal of the later described wear factor.

Dimensions

Figure 2A:
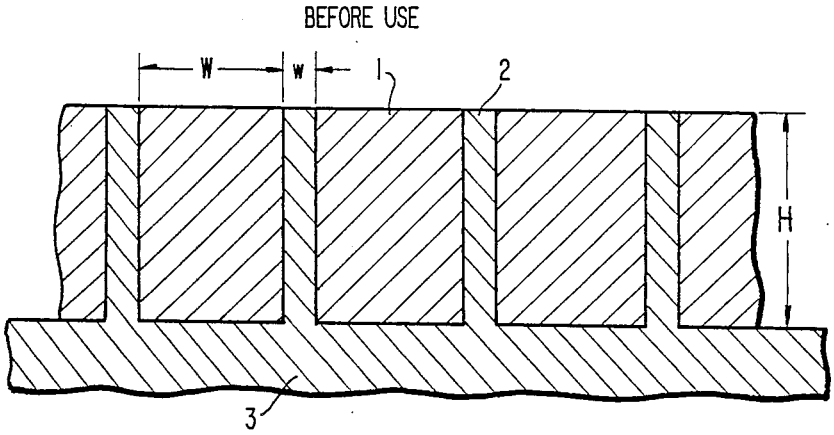
FIGS. 2(*a*) and 2(*b*) are sectional views showing the function provided by this composition.
Figure 2B:
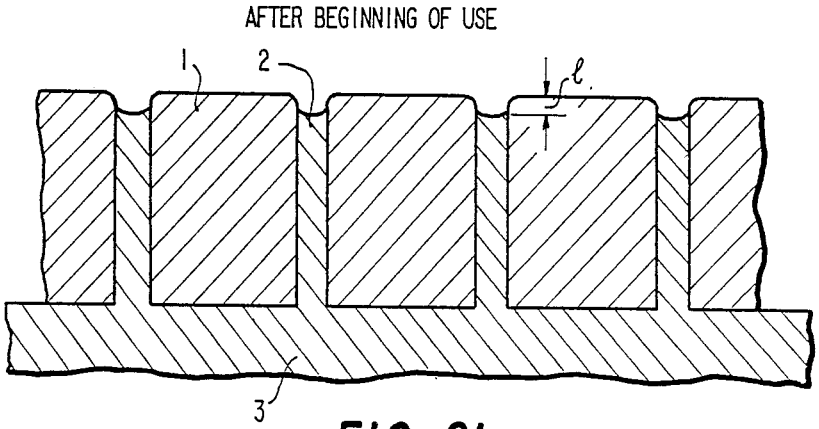

With reference to FIGS. 2*a* and 2*b*, the height H of the wear resistant blocks 1 and the spacer blocks 2 (in other words, the thickness of the part where they are arranged) should desirably be 3 mm or more. If it is less than 3 mm, generally it is difficult to ensure long life of the crushing surfaces a and b, irrespective of their materials. If H is high, however, the proportion of the wear resistant block relative to the whole of the crushing surface members A and B will increase, resulting in higher cost. The height H should, accordingly, desirably be limited to below 60 mm.

The top crushing surfaces of both blocks 1 and 2 should basically be on a common surface in their preoperation state. However, even if there are some differences in level between them, the spacer blocks will wear relatively rapidly upon starting of the operation, producing the specified recesses. Thus, no particularly serious problem will result if the two top crushing surfaces are not initially on a common surface.

The width w of the spacer blocks 2 is desired to be smaller than the width W of the wear resistant blocks 1. This is because, if w were to exceed W, the significance of providing the wear resistant blocks 1 would lessen, resulting in a reduction in the durability of the pulverizing surface members A and B. Moreover, vibration and noise would raise problems. However, if w were extremely small relative to W, the effect of improving the material nipping-in function would decline. Preferably, the range of w should be $0.1\times W$ to $1.0\times W$.

The widths w and W should be altered, depending on the material size, as a matter of course. Thus, if the material size is small, w and W both should of necessity be narrowed, whereby the material nipping-in will be adjusted to a favorable state.

The recesses due to wear has the effect of improving the material nipping-in state. On the other hand, however, if the depth 1 of the recesses is large, it will cause evolution of vibration or noise. An investigation conducted by the present inventor revealed that a depth 1 less than 0.5 mm has small effect on the nipping-in, but that a depth 1 in excess of 15 mm carried with it a higher possibility of producing vibration and noise. The recess depth 1 is governed mainly by the difference in wear resistance between the wear resistant blocks 1 and the spacer blocks 2. However, it is also influence by the width w of the spacer blocks 2. Accordingly, in order to obtain the desired depth 1, both the difference in wear resistance and the width w are adjusted.

Application Effect

Figure 7A:
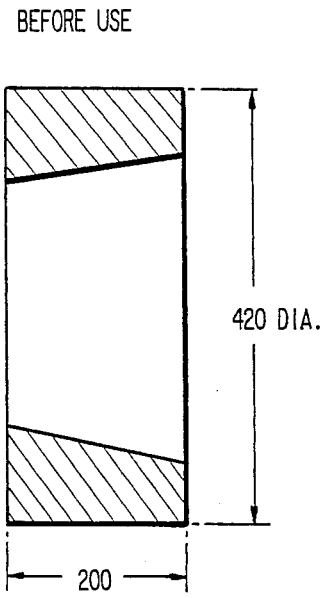
FIG. 7a PRIOR ART
FIGS. 7(*a*) and 7(*b*) are longitudinal side sectional views of a roll showing the wear situation of a roll of a ring roll mill.
Figure 7B:
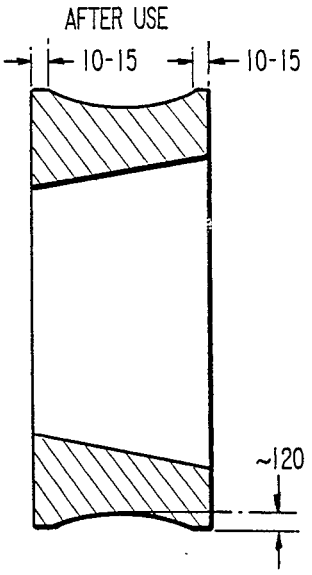
FIG. 7b PRIOR ART

FIGS. 7(*a*), 7(*b*), 8(*a*), and 8(*b*) illustrate an actual experiment. First, FIG. 7(*a*) and 7(*b*) show the dimensions of the rolls of conventional ring roll mills used for crushing graphite before and after operation. As the roll material, 14% manganese steel type JIS-ScMnHll was used. The life of the rolls was approximately 4 months, during which time they were placed in the following situation.

Before approximately 20 days had elapsed after operation with new rolls was started, the pulverizing efficiency was low, the rate of pulverization being approximately 7 tons per hour. However, after approximately 20 days had elapsed, the pulverizing efficiency gradually increased to 14 tons per hour at a maximum, giving approximately twice as high pulverizing efficiency.

This resulted from the fact that, because the new roll had a flat smooth surface, the material nipping-in did not proceed well. However, after a lapse of 20 days, uneven wear occurred on the roll surface, and the resultant wavy surface had the effect of improving the material nipping-in, resulting in increases in the amount of the material pulverized per unit time.

After the lapse of about 4 months, as shown in FIG. 7(*b*), the wear had greatly proceeded. In particular, an unbalanced wear was produced to a depth of 20 mm maximum at the center, as shown in the roller width direction, resulting in notable reduction in the pulverization efficiency, and roll replacement was necessary, notwithstanding the fact that adequate thickness was left at both roll ends.

In this situation, this invention was applied to the pulverizing rolls, and a test for confirmation of its effect of increasing initial output and extending life in service was pursued.

Figure 8B:
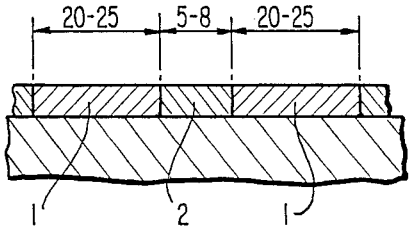
Figure 9A:
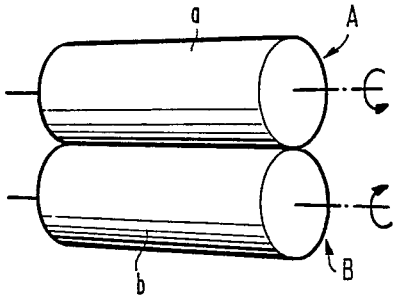
FIG. 9a PRIOR ART
FIGS. 9(*a*) through 9(*d*) are perspective views, each of which is a pictorial representation of the combined structure of crushing surface members in various types of crushers.
Figure 9B:
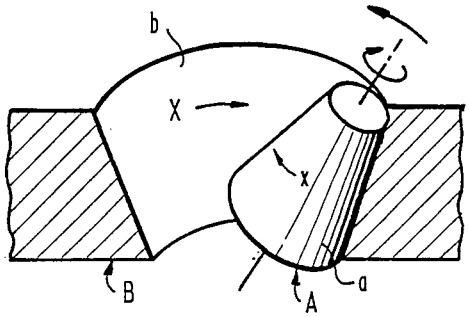
FIG. 9b PRIOR ART
Figure 9C:
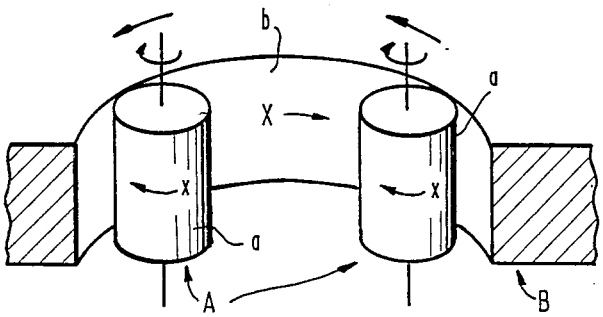
FIG. 9c PRIOR ART
Figure 9D:
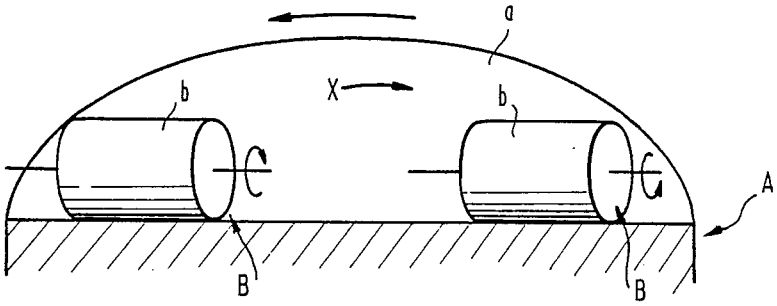
FIG. 9d PRIOR ART

As shown in FIGS. 8(*a*) and 8(*b*), a molten metal was padded as spacer blocks 2 by manual welding on the roll circumferential surface at intervals of 20–25 mm in the peripheral direction, and the rolls were finished with a grinder to a rectangular sectional shape with height 5–6 mm and width 5–8 mm. Thereafter, between each two of the spacer blocks 2, a molten metal which was superior to the aforementioned molten metal in wear resistance was formed into beads as the wear resistant blocks 1. Table 1 gives the component composition, hardness, and wear resistance of the welding rod used at that time. The wear resistance is represented by a wear factor (i.e., the amount of wear compared with the wear of SS41 as 100). ABRASODUR-16 has a 2.0 wear factor, which means that it has a wear resistance 50 times as high as that of SS41, and ABRASODUR-43 has a wear factor a further 4 times as high as the wear resistance of ABRASODUR-16.

Since on the rollers wear occurs concentrically at the central part, as seen in the width direction of the roller, the 10–15 mm width parts at both sides of the roll where no wear occurs were left, and inside of those parts the wear resistant blocks 1 and the spacer blocks 2 were arranged.

The wear factor is a comparative value of relative wear on the basis of abrasion test values in experimental testing. In actual applications, measured values will, therefore, be somewhat different from those given in Table 1.

TABLE 1

| Applied part | Welding rod | | | | | | |
|---|---|---|---|---|---|---|---|
| | Type | C | Cr | Nb | Mo | Hardness | Wear factor |
| Spacer block | ABRASODUR −16 | 4.0 | 9.0 | — | 2.0 | HRC 60 | 2.0 |
| Wear resistant block | ABRASODUR −43 | 5.5 | 22.0 | 8.0 | — | HRC 60 | 0.5 |

As the rolls composed in this way were put to use, the pulverization efficiency rose to 14 tons per hour after a lapse of only three days after starting the pulverizing operation. Further, the service life of the rolls was extended from the conventional 4 months to 8 months, during which time the production efficiency was continuously maintained at 14 tons per hour. Finally, no problems of noise and vibration occurred.

The above experiment clearly shows that the pulverizing surface member of this invention having two types of blocks differing in wear resistance alternately arranged at least in its surface layer part and recesses spontaneously formed in the blocks inferior in wear resistance to the other blocks improved the material nipping-in quality of the pulverizing member. The life of the pulverizing member itself is governed by the blocks having higher wear resistance, so that the pulverizing surface members as a whole show very high durability. Furthermore, in use of the blocks the recesses are kept constant in depth in correspondence with the difference in the wear resistance of the blocks. Accordingly, over the whole of their durability period, proper pulverizing efficiency is maintained. Moreover, since the recesses are spontaneously formed, evolution of noise and vibration resulting from the recesses is quite low.

Caveat

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A crushing member for use in a pulverizer having a nip-in direction, said crushing member having a crushing surface composed of two types of crushing blocks which differ in wear resistance and which are arranged alternately and at an angle of less than 45 degrees to the nip-in direction, said crushing blocks having outer surfaces which form a continuous smooth surface before use of said crushing member, whereby:

(a) when said crushing member is first used, the crushing blocks having a lower wear resistance will wear away more quickly than the crushing blocks having a higher wear resistance, forming recesses with depths 1, and (b) thereafter the two types of crushing blocks will wear away at approximately the same rate, preserving the recesses with depths 1.

2. A crushing member as recited in claim 1 wherein the crushing blocks having a higher wear resistance are wider in the nip-in direction than the crushing blocks having a lower wear resistance.

3. A crushing member as recited in claim 1 wherein said crushing member further comprises a substrate part.

4. A crushing member as recited in claim 3 wherein the crushing blocks having a lower wear resistance are formed integrally with said substrate part.

5. A crushing member as recited in claim 3 wherein the crushing blocks having a lower wear resistance are attached to said substrate part.

6. A crushing member for use in a pulverizer having a nip-in direction, said crushing member having a crushing surface composed of two types of crushing blocks which differ in wear resistance and which are arranged alternately in the nip-in direction, said crushing blocks having outer surfaces which form a continuous smooth surface before use of said crushing member, the crushing blocks having a higher wear resistance being wider in the nip-in direction than the crushing blocks having a lower wear resistance and the crushing blocks having a lower wear resistance having a wear resistance of from 10–90 percent of the wear resistance of the crushing blocks having a higher wear resistance, whereby:

(a) when said crushing member is first used, the crushing blocks having a lower wear resistance will wear away more quickly than the crushing blocks having a higher wear resistance, forming recesses with depths 1, and (b) thereafter the two types of crushing blocks will wear away at approximately the same rate, preserving the recesses with depths 1.

7. A crushing member as recited in claim 6 wherein said crushing blocks are arranged at an angle of between 0 degrees and 45 degrees to the nip-in direction.

8. A crushing member as recited in claim 6 wherein said crushing member further comprises a substrate part.

9. A crushing member as recited in claim 8 wherein the crushing blocks having a lower wear resistance are formed integrally with said substrate part.

10. A crushing member as recited in claim 8 wherein the crushing blocks having a lower wear resistance are attached to said substrate part.

* * * * *

UNITED STATES PATENT AND TRADEMARK OFFICE

CERTIFICATE OF CORRECTION

PATENT NO. : 4,848,683

DATED : JULY 18, 1989

INVENTOR(S) : HAJIME KAWATSU

It is certified that error appears in the above-identified patent and that said Letters Patent is hereby corrected as shown below:

In column 2, line 29, delete "is" and insert --in--.

Signed and Sealed this

Fourteenth Day of August, 1990

*Attest:*

HARRY F. MANBECK, JR.

*Attesting Officer*

*Commissioner of Patents and Trademarks*